United States Patent [19]

Fukatsu

[11] Patent Number: 4,464,644

[45] Date of Patent: Aug. 7, 1984

[54] PROCELAIN-CLAD ELECTRICAL MACHINE WITH VIBRATION-ON-TRANSPORTATION SUPPRESSION

[75] Inventor: Takeo Fukatsu, Takarazuka, Japan

[73] Assignee: Mitsubishi Denki Kabushiki Kaisha, Tokyo, Japan

[21] Appl. No.: 521,360

[22] Filed: Aug. 8, 1983

[30] Foreign Application Priority Data

Aug. 7, 1982 [JP] Japan ..... 57-120674[U]

[51] Int. Cl.[3] ..... H01F 27/02

[52] U.S. Cl. ..... 336/90; 336/92; 336/100

[58] Field of Search ..... 174/30; 336/90, 92, 336/100; 181/202

[56] References Cited

U.S. PATENT DOCUMENTS 1,583,383 5/1926 Bingay ..... 336/92 X 2,804,576 8/1957 Goggeshall et al. ..... 174/30

*Primary Examiner*—Thomas J. Kozma

*Attorney, Agent, or Firm*—Wenderoth, Lind & Ponack

[57] ABSTRACT

A transformer is fixed between two electrically insulating plates extending through a hollow porcelain tube connected at both ends to an upper and a lower tank through packings respectively and two compression controlled helical springs are disposed in the upper tank to controllably tension the mating electrical insulating plates with respect to the lower tank. The upper tank is also connected to the lower tank by means of at least three supporting rods disposed on the outside of the porcelain tube and including one end fixed to the upper tank and the other ends threaded and coupled to threaded studs welded to the lower tank through turnbuckles with a cushion interposed between the supporting rods and the porcelain tube.

3 Claims, 1 Drawing Figure

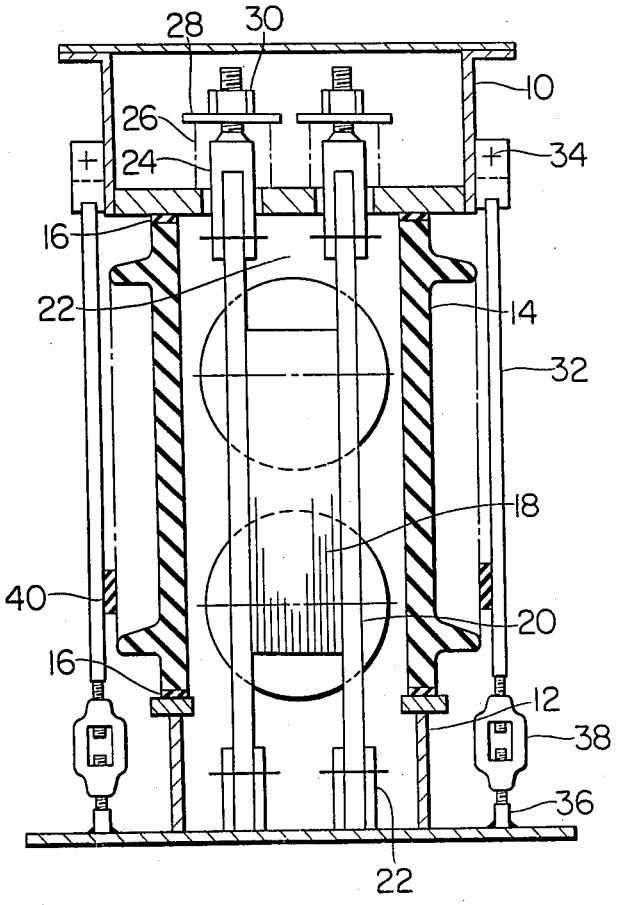
28
30
10
26
24
34
16
22
14
32
18
40
20
16
12
38
36
22

PROCELAIN-CLAD ELECTRICAL MACHINE WITH VIBRATION-ON-TRANSPORTATION SUPPRESSION

BACKGROUND OF THE INVENTION

This invention relates to improvements in a porcelain-clad electrical machine with a vibration-on-transportation suppression.

A conventional one of porcelain-clad electrical machine of the type referred to has comprised an upper tank, a lower tank, a hollow porcelain tube connected at both ends to the upper and lower tanks through respective packings, an electrical machine such as a transformer fixed between a pair of electrically insulating plates extending through the interior of the porcelain tube, and a compression controlled helical spring disposed in the upper tank to controllably tension an associated one of the electrically insulating plates with respect to the lower tank.

In the arrangement as described above each of the helical springs has been compressed by an associated fastening nut to cause a tensioning force on the associated electrically insulating plate. Then a reaction of the tensioning force imparts surface pressure to the packings on both ends of the porcelain tube to hold a relative positional relationship among the components involved as required.

Upon the transportation thereof, the porcelain-clad electrical machine such as described above may be applied with excessive vibrations which are generally in excess of five to ten times vibrations developed upon the installation. In order to ensure that the electrical machines have the resistance to such excessive vibrations, there is nothing for it but to increase a clamping force of the helical spring. This is because the surface pressures applied to the packings originate only from the clamping force of the helical springs. When the increase in clamping force lacks in the safety of the procelain-clad electrical machine, the porcelain tube has been provided on the inner wall of that end thereof adjacent to the lower tank with a center rest.

Those measures, however, have caused the electrically insulating plates and the associated components to be large as an increase in clamping force of the helical spring resulting in the necessity of rendering the porcelain tube, the tanks etc. large-scaled. Accordingly the cost of transportation has tended to be expensive.

Also the higher the clamping force of the helical spring the more the workability of compressing the helical spring will be deteriorated upon the compression thereof.

Furthermore with the center rest disposed on the inside of the procelain tube, the latter has been required to increase in dimensional tolerance of the inside diameter thereof. Therefore a cushion should be interposed between the inside of the porcelain tube and the center rest through the field adjustment. In addition it is difficult to externally confirm the status of the cushion after having been disposed on the inside of the porcelain tube. Thus problems have been raised in view of the quality and working of the center rest. Also there has been another disadvantage that the packing cost is expensive because the packing is strengthened upon the transportation.

Accordingly it is an object of the present invention to eliminate the disadvantage of the prior art practice as described above by the provision of a porcelain-clad electrical machine with a vibration-on-transportation suppression including additionally a simple means ensuring a resistance to excessive vibrations developed during the transportation thereof.

SUMMARY OF THE INVENTION

The present invention provides a porcelain-clad electrical machine with a vibration-on-transportation suppression comprising an upper tank, a lower tank, a hollow porcelain tube connected at both ends to the upper and lower tanks through respective packings, an electrical machine fixed between a pair of electrically insulating plates extending through the interior of the porcelain tube, a compression controlled helical spring disposed in the upper tank to controllably tension an associated one of the electrically insulating plates with respect to the lower tank, and also to apply to the packings surface pressures sufficient to assemble the upper and lower tank and the electrically insulating plates with the electrical machine into a unitary structure, and at least three supporting rods disposed at predetermined equal angular intervals on the outside of the bushing porcelain to connect and fix the upper tank to the lowr tank, each of the supporting rods having a adjustable length.

In a preferred embodiment of the present invention, each of the supporting rods may include one end fixed to the upper tank and the other end threaded and connected to a threaded stud welded to the lower tank through a turnbuckle screw threaded onto the threaded other end and the threaded stud.

Further an annular cushion may interposed between the supporting rods and the procelain tube as a center rest for the latter.

BRIEF DESCRIPTION OF THE DRAWING

The present invention will become more readily apparent from the following detailed description taken in conjunction with the accompanying drawing in which a single FIGURE is a longitudinal sectional view of one embodiment according to a procelain-clad electrical machine including the vibration-on-transportation suppression of the present invention with parts illustrated in elevation.

DESCRIPTION OF THE PREFERRED EMBODIMENT

Referring now to the drawing, there is illustrated one embodiment according to a porcelain-clad electrical machine including a vibration-on-transportation suppression of the present invention. The arrangement illustrated comprises an upper enclosed tank 10, a lower tank 12 open at one end and disposed below the upper tank 10, and a hollow porcelain tube 14 disposed between the upper and lower tanks 10 and 12 respectively by having both end surfaces connected to the bottom plate of the upper tank 10 and the opened surface of the lower tank 12 through packings 16 respectively. Disposed within the hollow porcelain tube 14 is an electrical machine 18 shown as being a transformer including a core type iron core and a pair of windings wound arround respective legs of the iron core.

Also a pair of electrically insulating plates 20 are disposed within the hollow procelain tube 14 to extend in parallel to each other and to the longitudinal axis thereof so as to fix the electrical machine 18 therebetween. Each of the electrically insulating plates 20 is fixed at the lower end as viewed in the drawing to the bottom of the lower tank 12 through a pin 22 and at the upper end somewhat extending through the bottom of the upper tank 10 to a suspension member 24 through another pin 22.

The suspension member 24 loosely extends through the bottom of the upper tank 10 and includes a helical spring 26 disposed around that portion thereof extending into the interior of the upper tank 10 between the bottom of the latter and a washer 28 inserted onto a threaded end portion of the suspension member 24 and forced toward the bottom of the upper tank 10 by a fastening nut 30 screw threaded onto the thread end portion of the member 24 to control the compression of the mating spring 26.

Heretofore, a center rest has been welded to the open end surface of the lower tank 10 to be contacted by the inner wall surface of the adjacent end portion of the hollow porcelain tube 14 with or without an annular cushion interposed therebetween. Therefore the disadvantages as described above have resulted.

According to the present invention, however, a plurality of supporting rods 32 or at least three rods are disposed at predetermined equal angular intervals in a circle on the outside of the porcelain tube 14 to leave a narrow angular space therebetween. Each of the supporting rods 32 includes one end, in this case, the upper end as viewed in the drawing connected to the upper tank 10 through a bolt 34 and the other end threaded and connected to a threaded stud 36 welded to the bottom of the lower tank 12 through a turnbuckle 38. Thus the turnbuckle 38 can be rotated to adjust a length between those points on the supporting rod 32 and the stud 36 engaged by the turnbuckle 38. In other words, the turnbuckle 38 serves a connecting member for adjusting the length of the associated supporting rod 32.

Then an annular cushion 40 is interposed between the supporting rods 32 and the porcelain tube 14.

From the foregoing it is seen that the helical springs 26 are operated to apply the surface pressures to the packings 16 as described above in conjunction with the conventional porcelain-clad electrical machine and simultaneously the supporting rods 32 connect the upper tank 10 to the lower tank 12 through the turnbuckles 38 to clamp the tanks to each other thereby to apply separate surface pressures to the packings 16. In other words, the surface pressures applied to the packings originate from first clamping forces due to the electrically insulating plates 20 and the associated components disposed within the procelain-clad electrical machine and second clamping forces due to the supporting rods 32 and the associated components disposed outside of the electrical machine.

The present invention has several advantages. For example, the resulting electrical machine can be small-sized, light in weight and therefore inexpensive. This is because the resistance to vibrations after the installation can result from the clamping force developed within the completed electrical machine while the resistance to excessive vibrations occurring during the transportation can be ensured by the clamping force developed outside of the electrical machine. Thus it is not required to strenghten the electrical insulating plates, the suspension members etc. disposed within the porcelain-clad electrical machine enough to withstand the excessive vibrations during the transportation. As a result, all the structural components disposed within the electrical machine can be small-sized and therefore the external components such the porcelain tube and others can be also small-sized.

Also the center rest for the bushing porcelain is formed of the annular cushion 40 interposed between the procelain tube and the supporting rods. This measure can eliminate the necessity of operatively coupling a center rest to the lower portion of the porcelain tube as described above in conjunction with the conventional electrical machine. Furthermore, the cushion 40 used as the center rest can be disposed in place through the easy installation operation while it is obversed. Thus the center rest is reliable and also excellent in quality. Thus the packing upon the transportation can be simplified and its cost can be inexpensive.

While the present invention has been illustrated and described in conjunction with a single preferred embodiment thereof it is to be understood that numerous changes and modifications may be resorted to without departing from the spirit and scope of the present invention.

What is claimed is:

1. A porcelain-clad electrical machine with a vibrations-on-transportation suppression comprising an upper tank, a lower tank, a hollow porcelain tube connected at both ends to the upper and lower tanks through packings respectively, an electrical machine fixed between a pair of electrically insulating plates extending through the interior of the procelain tube, a compression controlled helical spring disposed in the upper tank to controllably tension an associated one of the electrically insulating plates with respect to the lower tank and also to apply to the packings surface pressures sufficient to assemble the upper and lower tanks and the electrically insulating plates with the electrical machine into a unitary structure, and at least three supporting rods disposed at predetermined equal angular intervals on the outside of the porcelain tube to connect and fix the upper tank to the lower tank, each of the supporting rods having a adjustable length.

2. A porcelain-clad electrical machine with a vibrations-on-transportation suppression as claimed in claim 1 wherein each of the supporting rod includes one end fixed to the upper tank and the other end threaded and connected to a threaded stud welded to the lower tank through a turnbuckles screw threaded onto the threaded other end of the supporting rod and the threaded stud.

3. A porcelain-clad electrical machine with a vibrations-on-transportation suppression as claimed in claim 1 wherein the porcelain tube includes a center rest formed of an annular cushion interposed between the supporting rods and the porcelain tube.

* * * * *